United States Patent [19]

Groshens

[11] Patent Number: 4,869,081

[45] Date of Patent: Sep. 26, 1989

[54] BACKING CLOTH WITH A KNITTED UNDERLAYER, INTENDED FOR LINED GARMENTS AS WELL AS MANUFACTURING METHODS AND APPLICATIONS FOR PREPARING LININGS

[75] Inventor: Pierre Groshens, Flamicourt, France

[73] Assignee: Lainiere De Picardie, France

[21] Appl. No.: 244,624

[22] PCT Filed: Nov. 26, 1982

[86] PCT No.: PCT/FR82/00200

§ 371 Date: Aug. 26, 1983

§ 102(e) Date: Aug. 26, 1983

[87] PCT Pub. No.: WO83/01964

PCT Pub. Date: Jun. 9, 1983

Related U.S. Application Data

[63] Continuation of Ser. No. 527,519, Jul. 25, 1983, abandoned.

[30] Foreign Application Priority Data

Nov. 26, 1981 [FR] France ..... 81 22195

[51] Int. Cl.[4] ..... D04B 23/08

[52] U.S. Cl. ..... 66/192

[58] Field of Search ..... 66/191, 192, 196, 202

[56] References Cited

U.S. PATENT DOCUMENTS

| | | | |
|---|---|---|---|
| 1,054,233 | 2/1913 | Mueller | 66/195 X |
| 1,234,927 | 7/1917 | Myers et al. | 66/195 |
| 1,451,975 | 4/1923 | Branson | 66/192 |
| 2,029,880 | 2/1936 | Lindley | 66/192 |
| 2,150,133 | 3/1939 | Seidel | 66/192 |
| 2,691,286 | 10/1954 | Cooper | 66/192 |
| 3,171,272 | 3/1965 | Frith | 66/195 |

FOREIGN PATENT DOCUMENTS

| | | | |
|---|---|---|---|
| 261093 | 1/1968 | Austria | 66/192 |
| 163372 | 5/1921 | United Kingdom | 66/192 |

*Primary Examiner*—Ronald Feldbaum
*Attorney, Agent, or Firm*—Darby & Darby

[57] ABSTRACT

A strip of backing cloth that is adapted for use as padding in garments includes a knitted underlayer formed from a multiplicity of backing yarns and includes a series of successive, lengthwise areas positioned adjacent to one another. Each area is formed of backing yarns that vary in at least one of size and composition from the backing yarns forming a respective adjacent area. The variation in the backing yarns forming the areas provides the knitted underlayer with selectively variable reinforcement.

14 Claims, 7 Drawing Sheets

B4
1
2
3
4
20

31b
32b
33b
1b
34b
35b
36b
2b
37b
38b
39b
40b
3b
41b
42b
4b
20a
20
29
21
22
24
25
R1
R2
R3
R4

BACKING CLOTH WITH A KNITTED UNDERLAYER, INTENDED FOR LINED GARMENTS AS WELL AS MANUFACTURING METHODS AND APPLICATIONS FOR PREPARING LININGS

This is a continuation of application Ser. No. 527,519, filed Jul. 25, 1983 abandoned.

The present invention pertains to warp knitted backing cloth for garments, and specifically pertains to backing cloth which is intended for linings or padding to be used for the front portions of jackets, topcoats, or similar items of apparel. More specifically, the present invention pertains to backing cloth wherein a knitted underlayer, which is usually produced from extremely fine yarns, principally performs the function of providing support for thicker yarns which are incorporated within the aforementioned knitted underlayer and are held in place by said underlayer. Yarns of the latter type constitute the actual backing yarns.

It should be understood that the term "backing yarns" may be applied to yarns, which on account of considerable thickness for example, as well as a certain elasticity or crosswise compressibility in most instances, are used to endow a garment with a certain degree of "bulk" In this particular instance, the "backing yarns" are so-called "multifilament" yarns, namely yarns composed of many individual fibers, and this specific characteristic is essential for obtaining the desired effect indicated heretofore.

In other instances, the term "backing yarns" may refer to yarns which, on account of stiffness or crispness, are used to endow a specific portion of a garment with these properties. In this instance, backing yarns usually consist of multifilaments produced from goat hair or horsehair, in keeping with long-established techniques within the domain of "interfacing".

It has been acknowledged for a considerable period of time that it is preferable for linings or padding to furnish substantial crispness within the chest portion of a garment, and, in some instances, as far as the shoulder seam. However, the portions located below this area should be more supple, in order to ensure comfort, as well as in terms of the appearance of a garment during movement by the wearer.

In order to fulfill this requirement, there are methods of producing linings which consist of at least two superimposed pieces which are to be joined to one another by sizing or by seamless stitching, so that material which corresponds to the chest portion and ultimately to the portion in front of the shoulder shall possess greater crispness and/or provide greater bulk for the front of a garment.

Nevertheless, such a procedure requires preparation of composite linings with the previously indicated structure, whereby it is necessary to cut the corresponding pieces from fabrics which possess different characteristics, as well as positioning these pieces in relation to one another and performing dressing or stitching. It is obvious that multiple steps result in higher net costs, as well as causing production of garments to be time-consuming and complicated.

One of the purposes of the present invention is to provide backing cloth possessing a knitted underlayer, whereby it shall be possible to avoid the previously cited difficulties by eliminating all of the intervening steps mentioned heretofore and by reducing preparation of linings to mere cutting of a single piece of cloth which, by itself and as a result of manufacturing techniques, shall contain areas with variable reinforcement.

In accordance with the present invention, it is possible to achieve these results during production of the warp knitted backing cloth, by providing multiple lengthwise areas of variable reinforcement within the cloth which are intended to extend, after the cloth has been produced and then cut according to desired shapes for linings, crosswise in relation to front portions of garments. Each of these lengthwise areas extend in the warpwise direction and shall contain an arrangement of backing yarns which is to differ from arrangements of backing yarns used for adjacent areas, in terms of quantity and/or composition, or in terms of attachment to the knitted product.

In accordance with a preferred version of the present invention, it is possible to select the quantity and/or composition of and arrangement of backing yarns for each specific area in such a manner that the cloth shall be characterized by decreasing thickness and/or crispness from top to bottom, within the front portion of a garment.

Backing yarns can be interknitted with the knitted underlayer, or they can be attached to it by any conventional means, without being used to form stitches. In either instance, it is desirable to provide differences in weighting and/or composition of backing yarns by adopting measures whereby the guide bars within knitting machines, as a result of appropriate structure and positioning of cylinders, shall be supplied in an appropriate manner. Hence, in accordance with the general mode of applying the present invention, differences in the quantity and/or the composition of backing yarns according to specific areas shall permit production of a backing cloth having respective juxtaposed strips of material which possess different characteristics. These strips shall extend in the warp direction. Backing cloths which are to be used as lining in garments will be placed in the garment so that the strips possessing different characteristics or degree of a characteristic extend in a generally horizontal direction from the top to the bottom within the front of the garment. The backing cloth should therefore be produced with a width which approximately corresponds to the intended height of that front portion of a garment which is to contain the backing cloth.

Contemporary knitting machinery and warp knitting machines in particular such as Raschel machines do allow production of knitted pieces with considerable width. It is possible to produce a large number of backing cloths having strips possessing different characteristics in accordance with prior definitions and to separate these backing cloths by separating these strips from one another at a subsequent stitch point. Therefore, in terms of a preferred configuration which is intended to permit weftwise reduction of the number of areas with different respective settings for supplying the stitches from which backing yarns are to be distributed, as well as for the movements which shall ensure attachment of backing yarns within a knitted product, it shall be necessary to ensure that the basic strips alternate according to opposite directions, in such a manner that end portions of these strips which possess the same composition shall be respectively adjacent to one another and shall therefore require the same setting.

Furthermore, it is necessary, in accordance with the present invention, to ensure combining of the previously cited general characteristics with appropriate placement of thick yarns within each row of stitches between certain rows by conventional methods, in order to limit the stretchability and, ultimately, the flexibility of the complex fabric which is to be produced, according to the direction of said rows.

It should be understood that, in accordance with contemporary apparel production techniques, backing cloth must also be coated with a layer of a thermoadhesive product, which is applied to the cloth by conventional methods, according to series of stitches or complex lines which are intended to maintain the suppleness of garments. If continuous layers of such a product were to be applied uniformly, suppleness would unavoidably be lost. In general, coating according to groups of stitches or lines is performed by means of at least one calender roll operating in conjunction with a counterpressure roll, so that a precisely controlled level of pressure can be applied to particles of a thermoadhesive product, which must be softened beforehand by heating, in order to ensure partial absorption of said particles by the material prior to cooling.

At this point, it is appropriate to observe that strips of cloth with knitted underlayers produced in accordance with the present invention usually display differences in thickness between the various juxtaposed lengthwise portions, on account of differences in weights of backing yarns which these strips respectively contain.

Consequently, it is not possible for calender rolls to apply the same pressure to each lengthwise portion of a strip of fabric, because such a situation would produce improper application of thermoadhesive products to certain areas. It is known that adjustment of the pressure must be performed with precision, according to the thickness of the particular fabric.

Obviously, it is possible to consider providing a set of calender rolls whereby each roll, for example, could be placed at a level whereby widths and diameters of rolls for respective areas would correspond to thicknesses. Nevertheless, this hypothetically simple solution is entirely inapplicable, inasmuch as the width and thickness of lengthwise portions may vary considerably according to the requirements of individual clients or according to changes in requirements as a result of fashion trends during different periods. In any instance, it can be understood that such an arrangement would be extremely cumbersome and that, for this reason, it does not merit consideration.

Accordingly, the present invention also pertains to a method which, by simple means, allows thermoadhesive properties to be imparted to products which, as indicated heretofore, contain lengthwise areas with different respective thicknesses, without encountering the difficulties which have been mentioned heretofore.

Indeed, in accordance with the present invention, the method of providing thermoadhesive properties within a strip of cloth containing the previously indicated lengthwise portions with differing respective thicknesses is significant, inasmuch as it consists of initially applying particles of a thermoadhesive product by conventional means to an extremely long piece of cloth with limited, but uniform thickness. It is preferable for this piece of cloth to be extremely supple. Subsequently, it is necessary to ensure that the surface opposite the sized surface of such a sheet, with limited, but uniform thickness, shall be placed in contact with the appropriate surface of a strip of cloth produced in accordance with the present invention by means of simultaneous unrolling, at the same speed, from combined rollers. Ultimately, the respective surfaces can be joined by heating a suitable plastic foam product which is to be deposited by conventional means along the previously cited line of contact, while unrolling is taking place.

According to one particular procedure for preparing strips of thermoadhesive backing cloth which shall ultimately possess the previously indicated composition, the piece of fabric which is to be joined to the strip of backing cloth by heating should be considerably wider than the strip of backing cloth, and it should extend beyond said strip within the portion corresponding to the lower section of the front of a lined garment, thereby constituting the bottom portion of the actual lining for this particular section.

In situations where it may not ultimately be necessary to obtain a strip of backing cloth with thermoadhesive properties, it is obvious that precisely the same procedure can be applied with pieces of fabric which are of limited thickness, without placing any thermoadhesive products upon either side.

It shall be possible to understand the present invention more fully as a result of the subsequent description in relation to appended drawings, wherein:

FIG. 1 provides a general diagrammatic view of a strip of backing cloth, with different forms of reinforcement for lengthwise areas, in accordance with the present invention.

FIG. 2 provides a general diagrammatic view of multiple strips of cloth comparable to the strip appearing within FIG. 1. These strips have been produced upon an extremely wide machine, with juxtaposition of lengthwise areas which possess the same characteristics.

Similarly, FIGS. 4A and 4B, 5A and 5B, 6A and 6B, and 7A and 7B respectively represent second, third, fourth, and fifth methods for preparing other examples of strips of backing cloth containing lengthwise areas with different types of reinforcement.

Figure 8:
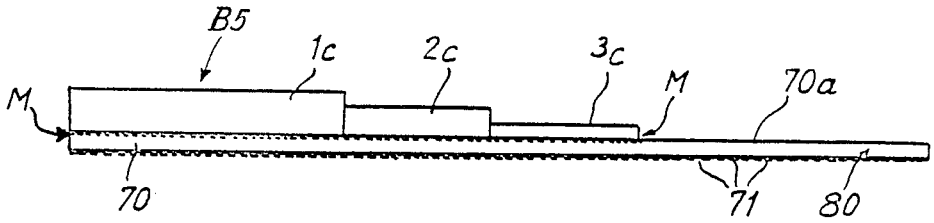

FIG. 8 is a crosswise diagrammatic view of a strip of backing cloth containing lengthwise areas with different thicknesses. This strip has been joined to a piece of fabric with limited thickness, with particles of a thermoadhesive product having been applied thereto.

Figure 9:
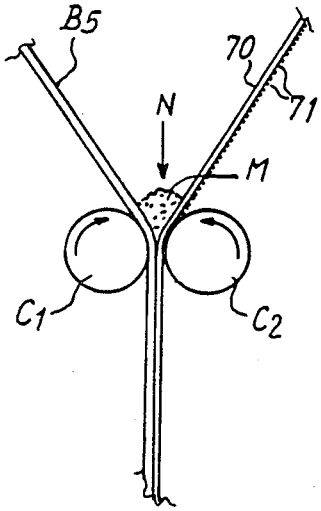

FIG. 9 is a diagrammatic view of the dressing procedure for a strip of backing cloth and a piece of fabric, in accordance with FIG. 8.

Figure 10:
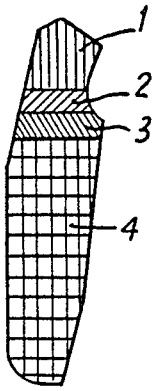

FIG. 10 represents the lining for the front portion of a garment, which is to be cut from a strip of backing cloth in accordance with the present invention.

Figure 11:
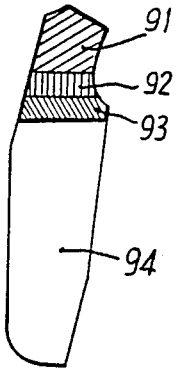

Like FIG. 10, FIG. 11 represents a lining cut from a strip of backing cloth which has been produced in accordance with the example shown within FIG. 8.

Figure 12:
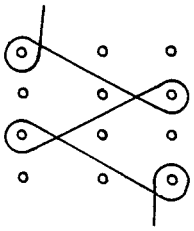
Figure 6A:
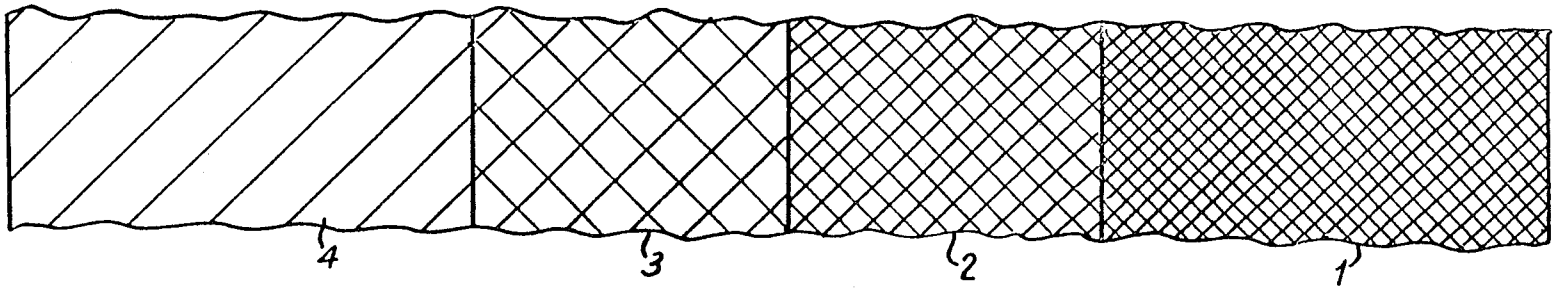
Figure 6B:
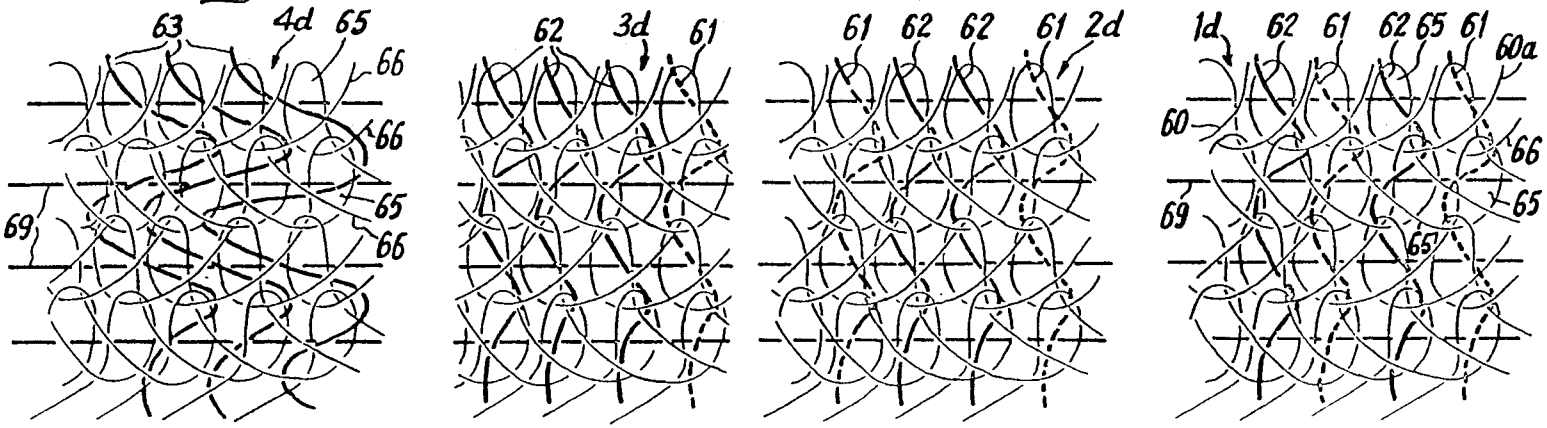
Figure 7A:
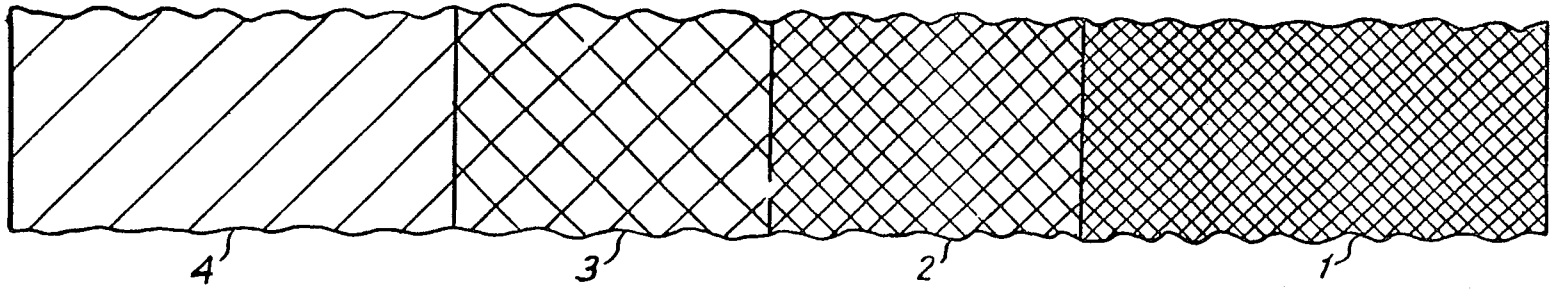
Figure 7B:
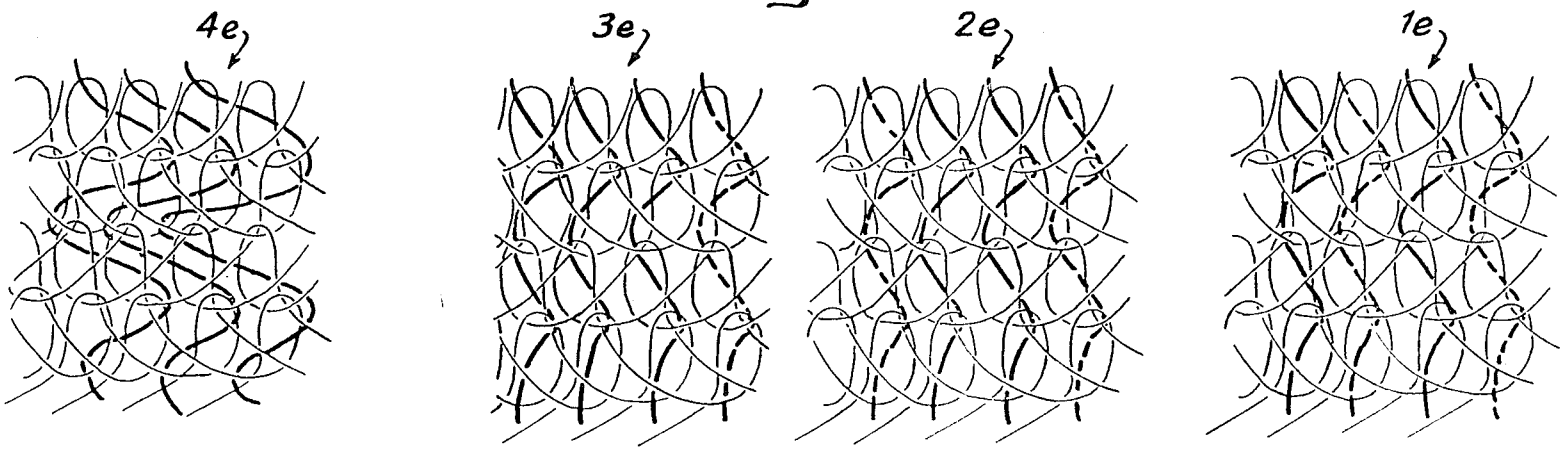

FIG. 12 is a schematic representation of the stitching of each area of FIGS. 6B and 7B.

Figure 1:
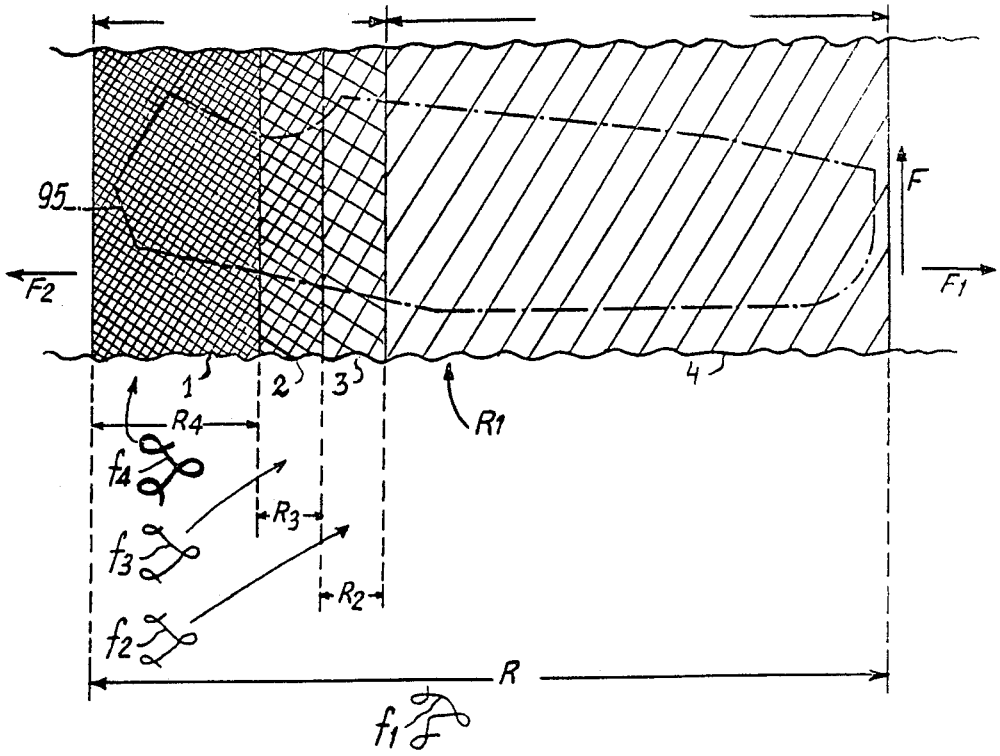

FIG. 1 shows a strip of backing cloth which is identified by the reference letter (R), and contains an area designated as (R1). This particular area consists entirely of a knitted underlayer represented by f1 and extends across the entire width of the strip of cloth (R), with reinforcement increasing in the respective lengthwise portions identified as (R2), (R3), and (R4). In this particular instance, reinforcement has been provided by knitting, so that the aforementioned underlayer (f1 yarns) are combined with backing yarns with gradually increasing thickness and/or stiffness, represented by (f2), (f3), and (f4). The type of stitching whereby these yarns have been incorporated within the knitted underlayer (R1) is also shown in a schematic form, although the stitching may be in accordance with any suitable lapping formula. An arrow (F) indicates the direction in which the material has been produced, whereas arrows identified as (F1) and (F2) express the fact that both sides of the strip of backing cloth (R) are adjacent to two more strips containing knitted underlayers with a similar structure, within an extremely broad piece of material of the type which can be produced on contemporary warp knitting machines, such as "Raschel" machines. It is known that machines of this type may be several meters long, thereby permitting production of pieces of knitted materials with comparable widths, as well as cutting of lengthwise strips with lesser widths by entirely conventional procedures.

Prior to presenting a detailed description of the various applications of the present invention, it can be observed, merely by consulting FIG. 1, that in order to produce each strip (R) of backing cloth containing respective areas (R1 through R4) of different characteristics, different machine settings will be required for each of these areas, in terms of movement of the guide bar or bars which distribute yarns for forming reinforced areas and in terms of distributing backing yarns with different characteristics according to lengthwise portions requiring different respective types of reinforcement. Therefore, different settings according to each strip of cloth shall be required for the cylinders which shall supply the stitch points corresponding to the aforementioned areas with yarns whose characteristics must correspond to the specific desired characteristics for each area.

Figure 2:
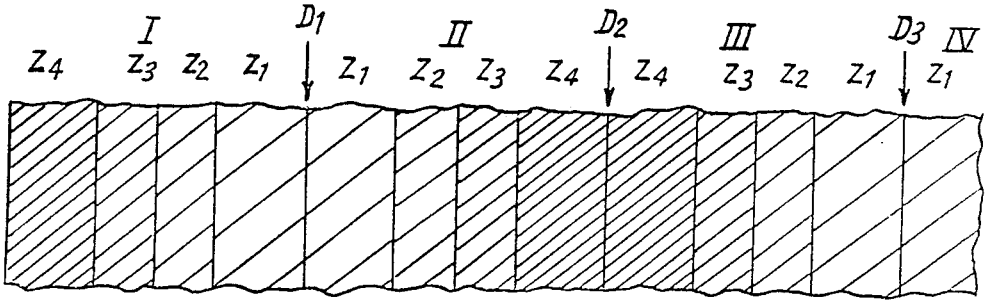

In accordance with the present invention, it is necessary to adopt measures for reducing difficulties associated with the multiplicity of required settings FIG. 2 shows individual strips of cloth with knitted underlayers (I, II, III and IV) which are to be separated from one another They are to be produced so that lengthwise areas at the end portions of two consecutive strips are of the same composition and situated adjacent to one another. Thus, only one setting is required for the entire width of two end portions, e.g. Z1 and Z1, Z4 and Z4), both in terms of operation of guide bars and in terms of supplying yarns to the stitches.

As shown in FIG. 2, the outermost strip (I) contains a border area with maximum reinforcement identified by (Z4) and other areas with gradually decreasing reinforcement identified by (Z3), (Z2), and (Z1), where the area (Z1) consists of the unreinforced knitted underlayer. Subsequent strips of backing cloth designated as (II), (III), and (IV) are located to the right of the outermost strip (I), are successively adjacent to one another, and are arranged in an alternating form, so that the two contiguous lengthwise areas identified as (Z1) and the two contiguous lengthwise areas Z4 constitute double width areas for which uniform settings and feed rates shall be appropriate.

This type of arrangement is highly advantageous when one takes into account the complex procedures which are required during setting of machines in order to change settings for the guide bars, as well as feed rates for the stitches, in accordance with the various lengthwise portions where different characteristics shall be required.

It is possible to obtain individual strips of backing cloth with varying reinforcement of the type described heretofore from an extremely broad strip knitted in this manner, by performing lengthwise cutting along center lines D1, D2 and D3 shown in FIG. 2 for the paired lengthwise areas identified as (Z1) and (Z4).

Figure 3A:
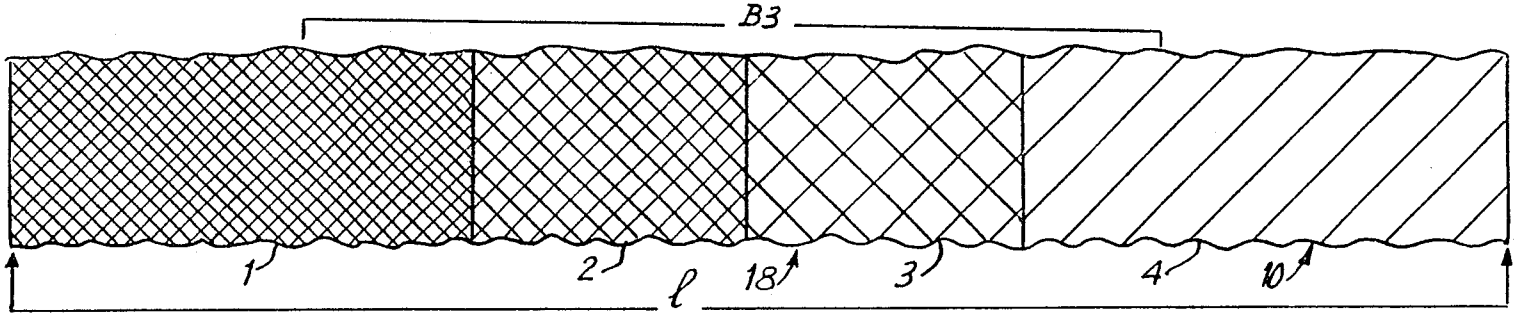
FIG. 3A is a diagrammatic view comparable to FIG. 1, showing a strip of backing cloth representing an initial example where three areas with different types of reinforcement are combined with a knitted underlayer.

FIG. 3A shows a strip of backing cloth B3 produced in accordance with an initial version of the present invention and having a total width designated as (L) and lengthwise areas which are identified as (1), (2), (3), and (4). The areas identified as (1), (2), and (3) respectively contain decreasing weights of backing yarns, with the first area (1) being the most dense, while the third area (3) is the least dense.

Within this particular example, however, the area identified as (4) consists solely of the knitted underlayer (10) composed of extremely fine yarns, except for "inlaid weft yarns" (19) which provide a supporting structure and therefore constitute the most flexible portion of the entire strip (B3). As indicated heretofore, it should be kept in mind that the knitted underlayer (10) not only encompasses the area identified as (4), but extends into other areas, (1), (2), and (3), in order to furnish support for the backing yarns constituting those areas. In this example, the backing yarns have been interstitched with yarns which comprise the knitted underlayer (10).

Figure 3B:
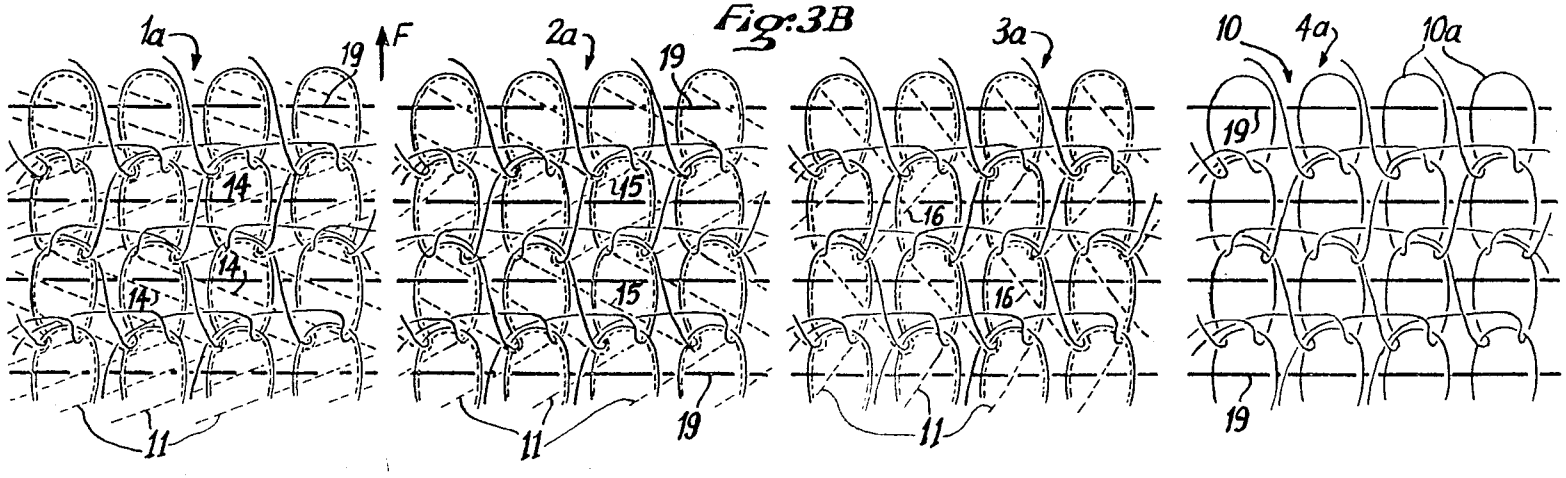
FIG. 3B is a detailed view of the composition of a portion of the aforementioned knitted underlayer, as well as portions of each of the three areas with different types of reinforcement.

Within FIG. 3B, the reference numbers (1*a*) through (4*a*) correspond to a greatly enlarged detailed representation of the type of knitting for each differently reinforced area corresponding to areas (1), (2), and (3), as well as for the unreinforced area (4) showin in FIG. 3A. With the exception of the inlaid long weft yarns (19) which are to be described hereinafter, this unreinforced area (4) consists of the knitted underlayer (10) containing extremely fine yarns (10*a*). As previously indicated, the knitted underlayer (10) also encompasses the entire remaining portion of the width (L) of the strip of backing cloth where it shall constitute a supporting layer.

In accordance with an initial example, backing yarns (11) shown in FIG. 3B for the lengthwise area 1*a*, which is the most dense area of backing yarns are to be knitted upon four needles corresponding to each row of stitches, whereby stitching shall be performed in an alternating form upon the outermost needles, from one row to the next, in order to provide zig-zag stitches (14) whose length shall correspond to the distance between the four needles.

Within the lengthwise area identified as (2*a*) in FIG. 3B and which is a less dense area of backing yarns than in lengthwise area 1*a*, these backing yarns (11) are knitted upon three needles corresponding to each row of stitches, with stitching being performed in an alternating form upon the outermost needles, from one row to the next, so as to produce zig-zag stitches (15) whose length correspond to the distance between the three needles.

Within the lengthwise area identified as (3*a*) in FIG. 3B, which is the least dense area of the fabric, backing yarns (11) are knitted upon two needles corresponding to each row of stitches, with consecutive stitching being performed upon these needles, from one row to the next, so as to produce zig-zag stitches (16) whose length correspond to the distance between two consecutive needles.

By examining FIG. 3B, it can therefore be observed that this method provides decreasing density or weight of backing yarns from the area identified as (1) to the area identified as (3), although the backing yarns (11) within this particular example are of the same composition and thickness.

Within the same example, by means of an entirely conventional arrangement, "an inlaid weft yarn" (19) has also been introduced within each row of stitches, at the point for closing stitches within each row, so that it shall extend along the entire length of each row. Use of an inlaid weft yarn is intended to limit crosswise stretchability in relation to the direction (F) in which the composite cloth shall be produced, as well as to limit flexibility, by means of characteristics selected for the inlaid weft yarns, and to provide interlacing with the area identified as (4*a*).

Obviously, introduction of inlaid weft yarns merely represents a possible alternative, and, depending upon the clients, requirements, it may not be necessary for cloth produced in accordance with the previously described method to contain inlaid weft yarns.

Figures 4A, 4B:
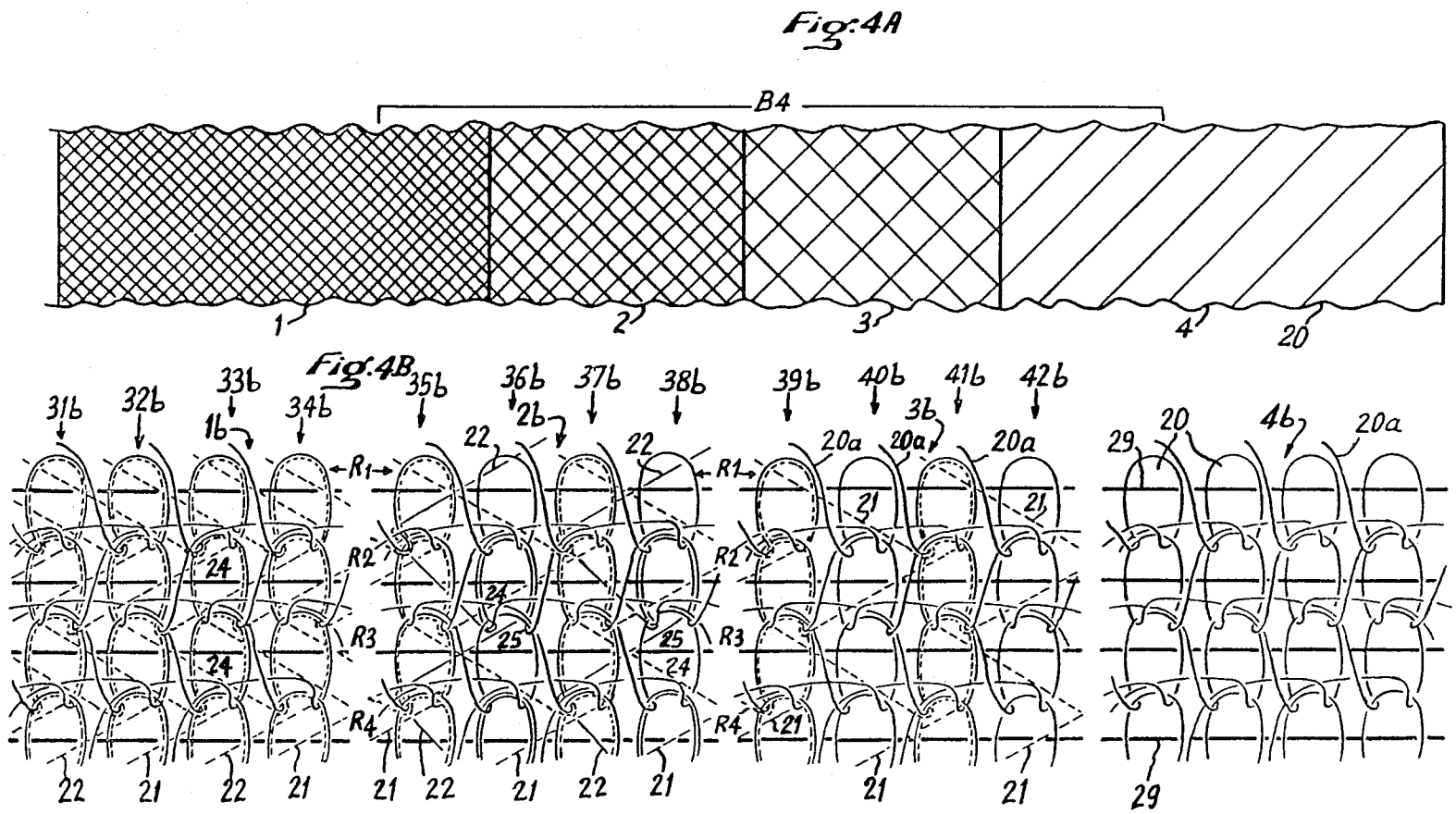

As shown in FIG. 4A, the strip of backing cloth which is identified as (B4) contains four lengthwise areas, similar to the previously described strip of backing cloth (B3). The same reference numbers, (1), (2), (3) and (4), have been used for these areas, even though a different method is used to produce these areas, as explained hereinafter. As in the preceding example, the areas identified as (1), (2), and (3) shall contain arrangements of backing yarns of decreasing bulk, whereby the area identified as (1) shall be the bulkiest area of the fabric and the area identified as (3) shall be the least bulkiest area.

Similar to the preceding example, the area identified as (4) consists solely of the knitted underlayer (20), which, in this instance, is composed of extremely fine yarns (20*a*), in the same manner as the knitted underlayer (10) within FIG. 3B.

In a form similar to FIG. 3B, the reference numbers (1*b*) through (4*b*) provide an enlarged detailed representation of knitting for each of the areas with varying reinforcement, (1), (2), and (3), as well as the unreinforced area (4) within FIG. 4A.

Within this particular example, the machine is outfitted with two guide bars, with one guide bar producing stitches (24) in one direction on three needles and then in the other direction, in an alternating form from one row of stitches to the next, whereas the other guide bar produces stitches (25) in the same manner, although only two needles are employed Stitches 24 and 25 are shown in lengthwise areas (1*b*) and (2*b*) of FIG. 4B.

For the lengthwise area identified as (1*b*) in FIG. 4B and which is the bulkiest area of the fabric, backing yarns (21) and (22), which possess an identical composition, are threaded onto each stitch (full threading) for a sole guide bar, which is to be referred to as "the first bar" insofar as the present description may be concerned, with stitching being performed upon three needles. Therefore, the yarns, (21) and (22), for each row of stitches, namely (R1) through (R4) within FIG. 4B, are knitted by the outermost needles according to the length of each warp, and it is obvious that these yarns are also interstitched with yarns (20*a*) for the knitted underlayer, upon the same needles.

The lengthwise area identified as (2*b*) in FIG. 4B is a less bulky area of backing yarns than area 1*b*, and this difference is derived from the fact that backing yarns (21) within area (2*b*) are threaded upon one of the two stitches (half-threading) on the first guide bar, which produces stitches (24) using three needles, whereas the backing yarns identified as (22) are likewise threaded upon one of the two stitches (half-threading) on the second guide bar, with two needles being used to produce stitches (25).

As a result of this arrangement, yarns (21) for the first guide bar shall be stitched in an alternating form within one among each three rows of stitches (35*b*, 37*b*), whereas yarns (22) for the second guide bar are to be stitched according to two consecutive rows of stitches, alternating with subsequent groups containing two consecutive rows of stitches, as in the following example: rows (35*b*) and (36*b*) for one of the yarns (22) from the second guide bar, followed by rows (37*b*) and (38*b*) for the other yarn (22) on the same guide bar, which, it should be recalled, has been set for "half-threading".

Within the lengthwise area identified as (3*b*), which is the least bulky area of backing yarns (21), yarns are threaded upon one of the two stitches (half-threading) on the first guide bar, and, of course, stitching for each of the rows (R1 through R4) is to be performed in the manner described heretofore.

As a result of this particular arrangement, yarns (21) for the area identified as (3*b*) shall be stitched according to one row among each three rows (39*b*, 41*b*), as in the instance of areas (1*b*) and (2*b*), whereas no backing yarns (22) shall be introduced within intermediately situated rows of stitches (40*b*), (42*b*), on account of the absence of said yarns.

As a result of this over-all configuration, arrangements of backing yarns of decreasing bulk shall be provided for the lengthwise areas identified as (1) through (3), whereas the area identified as (4) shall consist solely of the knitted underlayer (20), as in the preceding example. It is appropriate to recall that the knitted underlayer shall extend across the entire width of the strip of cloth (B4), so as to constitute a supporting layer or underlayer.

As in the preceding example, it is preferable for inlaid weft yarns, identified as (29), to be introduced within each row of the knitted product, in order to permit significant restriction of stretchability according to the direction for rows of stiches and in order to provide interlacing.

Figure 5A:
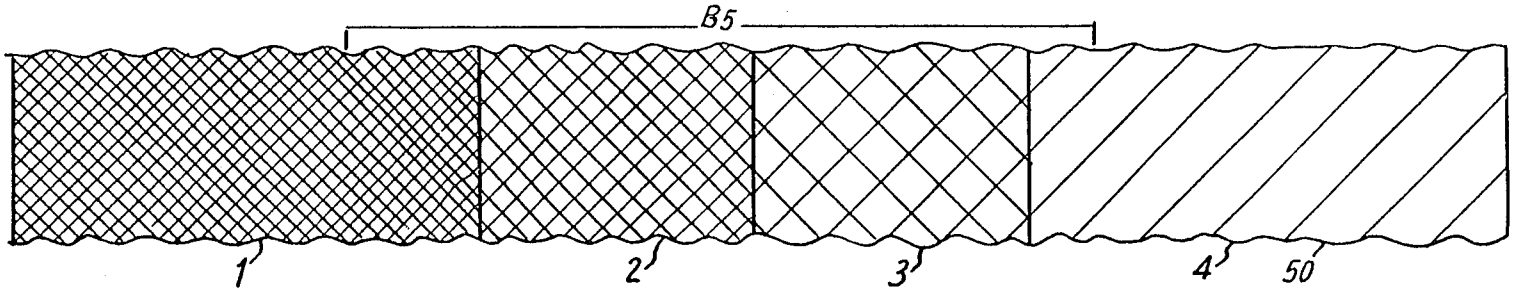
Figure 5B:
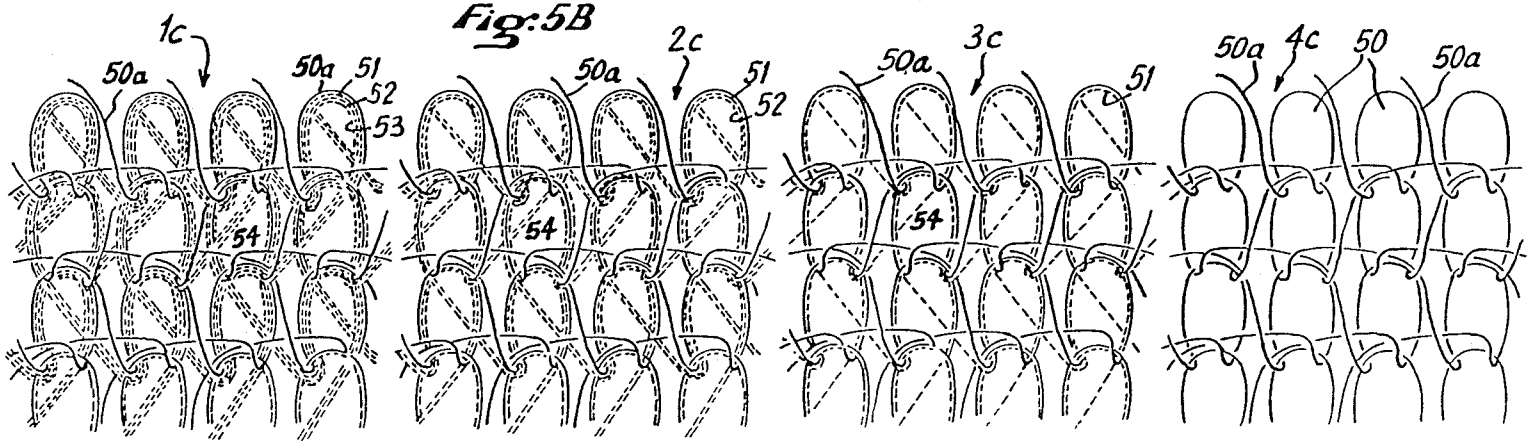

For FIGS. 5A and 5B, which correspond to a third example of application of the present invention, the reference numbers (1), (2), (3), and (4) have again been used to identify four lengthwise areas of a strip of backing cloth (B5). As in the two preceding examples, the areas identified as (1), (2), and (3) contain arrangements of backing yarns of decreasing bulk, with the first area (1) being the bulkiest area and the third area (3) being the least bulky area.

As in the preceding example, the area identified as (4) in FIG. 5A consists solely of the knitted underlayer (50) which consists of fine yarns (50*a*). Within this particular example, inlaid weft yarns comparable to inlaid weft yarns (19) or (29) are not used, although it would be possible to include yarns of this type.

Detailed representations 1*c* through 4*c* of the knitting for each of the aforementioned areas, (1) through (4), is shown in enlarged form in FIG. 5B.

Within this particular example, the knitting machine contains only one guide bar for distributing backing yarns, and this guide bar shall provide a warp knit (54) between two needles, from one row of stitches to the next.

In order to regulate the composition of the areas designated as (1), (2), and (3), which are to contain different arrangements of backing yarns, each guide on the guide bar shall be threaded with three individual backing yarns (51, 52, 53), according to the lengthwise area identified as (1) in FIG. 5A (1*c* in an enlarged form shown in FIG. 5B). These yarns, for example, can be identical yarns which are to be interstitched upon each needle with the yarns (50*a*) being used for the knitted underlayer.

For the adjacent area identified as (2) in FIG. 5 (2*c* in an enlarged form), precisely the same arrangement shall be adopted, although only two individual backing yarns (51. 52) are to be threaded at each stitch.

For the lengthwise area identified as (3) (3*c* in an enlarged form), this arrangement shall be adopted again, although the corresponding stitches shall be threaded with only one backing yarn.

Consequently, the area identified as (1) shall be the most filled area of backing yarns, whereas the area identified as (3) shall be the least filled area and the area identified as (2) shall be an area of intermediate bulk.

It is appropriate to observe that, instead of providing different numbers of backing yarns at the respective stitches for each of the areas identified as (1), (2), and (3) it would also be possible to use thick backing yarns for the first area (1), finer backing yarns for the second area (2), and even finer backing yarns for the third area (3).

It is also appropriate to observe that, within each of the preceding examples represented by FIGS. 3A and 3B, 4A and 4B, and 5A and 5B, the yarns for the knitted underlayer have been looped upon each needle, although knitting has been performed in a different manner than for material composed of backing yarns. In fact, upon examining the drawings, it can be determined that, within each of the three preceding examples, backing yarns have been knitted with open stitches, whereas knitting for the knitted underlayer has been performed with closed stitches. Furthermore, stitching for the knitted underlayer is the same across the entire width of the strip of backing cloth.

FIGS. 6A and 6B represent an inversion of the basic arrangement shown within FIGS. 3A through 5B, inasmuch as the area with maximum reinforcement is situated on the right side, rather than the left side. The knitted underlayer in the example shown in FIG. 6 is the same for each of the areas 1*d* through 4*d*. Although the stitching for the underlayer of the warp knit backing cloth could be in accordance with any suitable lapping formula, the notation for the closed stitching on three needles shown in FIG. 6B is 2-0/1-3. A schematic representation of the stitching is shown in FIG. 12.

Within this particular example, the machine was set in a conventional manner, whereby backing yarns (61, 62) which are also inlaid warp yarns would not be used in forming stitches within the knitted underlayer (60), which is composed of yarns identified as (60*a*). By means of the guide bar used to distribute backing yarns, these yarns were merely included within each row of stitches in a slightly crimped form, between the loops (65) for stitches and the underlap (66), so that yarns could be attached to the knitted product without being used to form stitches, as in the preceding examples.

For the areas identified as (1), (2), and (3), which are designated as (1*d*), (2*d*), and (3*d*) in an enlarged form and shown in FIG. 6B, the material contains one inlaid warp yarn per row of stitches, regardless of the specific portion of said material. Nevertheless, two different types of inlaid warp yarns have been employed in this instance. Inlaid warp yarns identified as (61) are stiff and crisp yarns which shall subsequently be referred to as "crisp yarns," whereas inlaid warp yarns identified as (62) are thick and flexible filling yarns, which are intended to impart a certain bulkiness. Indeed, the inlaid warp yarns identified as (61) generally consist of monofilaments which are considerably thicker than yarns comprising the underlayer. Nevertheless, it is also possible for these yarns to consist of multifilaments which are produced from goat hair, for example, in keeping with a widely used method for providing interfacing. In contrast, the inlaid warp yarns identified as (62) consist of flexible multifilaments which are characterized by limited stretchability or compressibility in a cross-wise direction, so that they shall be suitable for use as filling yarns. Therefore, these yarns are not characterized by crispness, in contrast to the yarns identified as (61).

Within the present example, the essential difference among the three areas identified as (1*d*), (2*d*), and (3*d*) consists of a difference in lengthwise crispness for the corresponding areas identified as (1), (2), (3), whereby the area identified as (1*d*) possesses the greatest crispness and the area identified as (3*d*) possesses the least crispness.

In order to obtain these results, the stitches corresponding to the area identified as (1) must be half-threaded with a crisp yarn (61), whereas a flexible filling yarn (62) must be used for half-threading intermediately situated stiches.

In relation to the area identified as (3), it is necessary for one among each four stitches to be supplied with crisp yarn (61), whereas flexible filling yarn (62) should be fed to each of the three intermediately situated stitches.

Therefore, among the areas identified as (1), (2) and (3), crispness decreases from the first area (1) to the second area (2), to the third area (3), as a result of decreasing quantities of crisp yarns (61).

It is appropriate to observe that, instead of arranging the inlaid warp yarns (61, 62) so that they could be attached between the underlap and loops for stitches, it would also be possible to provide a straight-line arrangement within areas situated between two consecutive rows of stitches, where yarns would be held in place by the underlap, which would be positioned so as to extend over and under the yarns (61, 62) according to a conventional configuration. Nevertheless, the configuration which has been described heretofore was considered to be preferable, inasmuch as it permitted more effective attachment of inlaid warp yarns (61, 61) to the knitted underlayer.

Within this particular example, the lengthwise area identified as (4), or (4*d*) is a continuation of the area identified as (3), or (3*d*), crosswise to the direction for producing the material and in an opposite direction from the area identified as (2). Area 4 (4*d* in an enlarged form) is intended to constitute the lower portion of a lining, and, by a conventional method, "weft" yarns (63) have been introduced in a zig-zag configuration, with pronounced crimping, within several rows of stitches, between the loops for said stitches (65) and the underlap (66). It is preferable for the weft yarns (63) to be flexible yarns, with less thickness than the yarns identified as (61) and (62). These yarns are intended to impart stretchability and flexibility to the corresponding portion of the material, which shall constitute the bottom portion of a lining, and they shall also provide adequate bulk for the material.

Lastly, in relation to the example represented by FIGS. 6A and 6B, it should be observed that, in the same form as the examples appearing within FIGS. 3A, 3B, 4A, and 4B, inlaid weft yarns (69) have been introduced within the material. In this instance, the function of inlaid weft yarns is also the significant reduction of stretchability, according to the same direction.

FIGS. 7A and 7B represent still another example of application of the present invention. It shall not be described in a detailed form. This example is directly derived from the version represented by FIGS. 6A and 6B, with the elimination of the inlaid weft yarns (69). In this way, it is possible to produce a strip of cloth similar to the strip described and shown in FIGS. 6A and 6B, although this strip is distinguished by crosswise stretchability of the cloth according to the different lengthwise areas identified as (1) (1*e*), (2) (2*e*), (3) (3*e*), and (4) (4*e*). The knitted underlayer in the example shown in FIG. 7 is the same for each of the areas *e* through 4*e*. Although the stitching for this warp knit backing cloth could be in accordance with any suitable lapping formula, the closed stitching shown in FIG. 7 is performed on three needles according to the notation 2-0/1-3 which is identical to FIG. 6.

FIG. 8 represents a cross-section according to the direction in which a strip of backing cloth in accordance with the present invention is to be produced, and it contains three lengthwise portions comparable to areas (1*c*) through (3*c*) within FIG. 5B, having arrangements of backing yarns of decreasing bulk. It can also be observed that the thickness of these areas decreases and that FIG. 8, without indicating the calendar rolls, exemplifies the difficulties which would exist in terms of applying sizing according to stitches to the bottom surface of the material. Indeed, it is obvious that the proper pressure setting for applying particles of sizing agents within the area identified as (1*c*) would be unsuitable for the area identified as (2*c*) and even more unsuitable for the area identified as (3*c*).

In order to overcome this problem, it is necessary, in accordance with the present invention, to place a fine and uniform layer of material (70) upon one of the surfaces of the strip of backing cloth, with sizing agents having been previously applied at (71) by traditional procedures.

A strip of cloth produced in accordance with the present invention, such as (B5) in this particular example, is shown within FIG. 9 after it has been applied to a layer of material (70) on the surface opposite the surface containing a thermoadhesive product (71), by being placed in contact with the former surface and unrolled in a continuous form between rotary cylinders (C1, C2), which ensure contact, whereas a foam composed of a appropriate plastic substance (M) has been spread along the line of contact, with heat joining having been performed at (N) by any suitable method, in order to cause melting of the latter substance and in order to cause the strip of backing cloth (B5) to adhere to the layer of material identified as (70).

It is appropriate to understand that, in this particular instance, the actual composition of the plastic foam product renders it unnecessary to adopt measures for applying precisely determined levels of pressure to the various portons of the strip (B5) and to the material (70) being used to complete dressing procedures for said strip of cloth.

It is therefore possible to perform thermofusing of linings cut from composite strips produced by this method with the same procedures which are used for conventional thermoadhesive fabrics.

In relation to FIG. 8, it should be observed that the width of the thin thermoadhesive layer is considerably greater than the width of the backing cloth composed of areas identified as (1*c*), (2*c*), and (3*c*). Thus, the portion identified as (70*a*) which overlaps the area identified as (3*c*) is suitable for use as an area of limited thickness (80) intended to replace the area identified as (4*c*) within the strip of backing cloth (B5).

FIG. 10 represents a lining for the front portion of a garment which has been cut from a strip of backing cloth whose composition corresponds, for example, to the version of the present invention represented by FIGS. 6A and 6B. In this instance, the upper area (1) possesses the same characteristics as the enlarged area represented by (1*d*) within FIG. 6B, while the area designated as (2) possesses the same characteristics as the area represented by (2*d*), with the third area (3) possessing the same characteristics as the area represented by (3*d*) and with the fourth area (4) possessing the same characteristics as the area represented by (4*d*).

FIG. 11 corresponds to a lining for the front portion of a garment which has been cut from a strip of backing cloth whose composition, for example, can correspond to the versions appearing within FIGS. 5A, 5B, and 8. In this instance, the upper area (91) possesses the same characteristics as the enlarged area represented by (1*c*) within FIG. 5B, while the area designated as (92) possesses the same characteristics as the area represented by (2*c*), with the third area (93) possessing the same characteristics as the area represented by (3*c*) and with the fourth area (94) possessing the same characteristics as the area identified as (80) within FIG. 8.

Linings for the front portions of garments, as shown within FIG. 10 or FIG. 11, which are obtained from cutting a strip of backing cloth prepared in accordance with the present invention, namely in a crosswise direction in relation to the direction in which the fabric is to be produced, is indicated in schematic form by dashes (95) within FIG. 1.

It is obvious that the examples of application of the present invention which have been described heretofore, or indicated within the drawings, are not restrictive, and that numerous modifications could be introduced without departing from the context of this particular invention.

I claim:

1. A strip of warp knitted backing fabric adapted for use as lining or the like in garments, which comprises:
   (a) a knitted ground fabric having wales and courses, said knitted ground fabric having a series of successive, lengthwise fabric areas positioned adjacent to one another;
   (b) a plurality of warpwise inlaid yarns in each of said fabric areas, said inlaid yarns in at least two different fabric areas having at least one of (i) different individual yarn characteristics and (ii) different numbers of warpwise inlaid yarns; such that said two fabric areas have different individual predetermined properties.

2. A strip of warp knitted backing fabric as in claim 1 wherein the knitted ground fabric has a single thickness over its entire length and width.

3. A strip of warp knitted backing fabric as in claim 2 wherein said individual characteristics is crispness.

4. A strip of warp knitted backing fabric as in claim 2 wherein said individual characteristics is yarn size.

5. A strip of warp knitted backing fabric as in claim 2 wherein said individual characteristics is density.

6. A strip of warp knitted backing fabric as in claim 2 wherein said individual characteristics is bulk.

7. A strip of warp knitted backing fabric as in claim 2 wherein said individual characteristics is type of yarn.

8. A strip of warp knitted backing fabric as claimed in claim 2 wherein said knitted ground fabric has at least first, second, third and fourth fabric areas, the first, second and third fabric areas being composed of a blend of crisp yarns and thick and flexible yarns, said yarns in said first area being in approximately equal proportions, said yarns in said second area being in proportion of one crisp yarn to two thick and flexible yarns, said yarns in said third area being in proportion of one crisp yarn to three thick and flexible yarns, said yarns in said fourth area being composing of flexible yarns which are thinner than said crisp yarns and said thick and flexible yarns.

9. A strip of warp knitted backing fabric as defined by claim 1 wherein said lengthwise fabric areas further include inlaid yarns in the weftwise direction, said inlaid yarns in the weftwise direction in at least two lengthwise fabric areas having at least one of (i) different individual predetermined characteristics and (ii) different numbers of weftwise inlaid yarns.

10. A strip of warp knitted backing fabric as in claim wherein said individual characteristics is stiffness.

11. A strip of warp knitted backing fabric in claim 9 wherein said individual characteristics is flexibility.

12. A strip of warp knitted backing fabric as claimed in claim 8 wherein said lengthwise fabric areas further include inlaid yarns in the weftwise direction, said inlaid yarns in the weftwise direction in at least two lengthwise fabric areas having at least one of (i) different individual predetermined characteristics and (ii) different numbers of weftwise inlaid yarns.

13. A strip of warp knitted backing fabric adapted for use as lining or the like in garments, which comprises:

(a) a knitted ground fabric having wales and courses, said knitted ground fabric having a series of successive, lengthwise fabric areas positioned adjacent to one another;

(b) a plurality of warpwise inlaid yarns in each of said fabric areas, said warpwise inlaid yarns in at least to different fabric areas having at least one of (i) different individual yarn characteristics and (ii) different numbers of warpwise inlaid yarns; and (c) a plurality of weftwise inlaid yarns in each of said fabric areas, said weftwise inlaid yarns in at least two different fabric areas having at least one if (i) different individual yarn characteristics and (ii) different numbers of weftwise inlaid yarns such that said two fabric areas have different individual predetermined properties.

14. A strip of warp knitted backing fabric as in claim 13 wherein the knitted ground fabric has a single thickness over its entire length and width.

* * * * *